US006962048B2

(12) United States Patent
Ashida et al.

(10) Patent No.: US 6,962,048 B2
(45) Date of Patent: Nov. 8, 2005

(54) ENGINE EXHAUST APPARATUS

(75) Inventors: Masaaki Ashida, Yokohama (JP); Kimiyoshi Nishizawa, Yokohama (JP); Katsuhiro Shibata, Tokyo (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 10/609,632

(22) Filed: Jul. 1, 2003

(65) Prior Publication Data

US 2004/0020195 A1 Feb. 5, 2004

(30) Foreign Application Priority Data

Jul. 30, 2002 (JP) ..... 2002-221168

(51) Int. Cl.[7] ..... F01N 3/10

(52) U.S. Cl. ..... 60/302; 60/299; 60/321; 60/322; 60/323

(58) Field of Search ..... 60/299, 300, 301, 60/305, 322, 323, 321, 302

(56) References Cited

U.S. PATENT DOCUMENTS

| | | | | |
|---|---|---|---|---|
| 4,151,715 A | | 5/1979 | Tachibana et al. | |
| 4,420,933 A | | 12/1983 | Kajitani et al. | |
| 5,410,877 A | * | 5/1995 | Shimada et al. | 60/302 |
| 5,787,709 A | * | 8/1998 | Watanabe et al. | 60/313 |
| 5,816,044 A | * | 10/1998 | Biggs | 60/313 |
| 6,009,706 A | * | 1/2000 | Haneda | 60/323 |
| 6,082,103 A | | 7/2000 | Sugiura et al. | |
| 6,702,062 B2 | * | 3/2004 | Kusabiraki et al. | 181/240 |
| 6,745,561 B2 | * | 6/2004 | Kim | 60/323 |

FOREIGN PATENT DOCUMENTS

| | | |
|---|---|---|
| DE | 41 27 633 A1 | 2/1993 |
| DE | 199 38 689 A1 | 2/2001 |
| EP | 0 313 922 A1 | 5/1989 |
| EP | 0 818 616 A1 | 1/1998 |
| FR | 2 663 986 A1 | 1/1992 |
| JP | 2-16016 Y2 | 5/1990 |
| JP | 8-68316 A | 3/1996 |
| JP | 2000-337143 A | 12/2000 |

OTHER PUBLICATIONS

Patent Abstracts of Japan, vol. 1997, No. 09, Sep. 30, 1997, JP 09–125947, May 13, 1997.
U.S. Appl. No. 10/379,681, filed Mar. 6, 2003, Ashida et al.

* cited by examiner

*Primary Examiner*—Binh Q. Tran
(74) *Attorney, Agent, or Firm*—Foley & Lardner LLP

(57) ABSTRACT

An exhaust manifold of an engine exhaust apparatus includes a plurality of exhaust branches and a straight pipe section. The exhaust branches extend toward a confluence portion, from respective upstream ends to be connected with cylinders of an engine. The straight pipe section extends from the confluence portion toward a downstream end adapted to be connected to an exhaust purifying catalyst.

17 Claims, 11 Drawing Sheets

ENGINE EXHAUST APPARATUS

BACKGROUND OF THE INVENTION

The present invention relates to exhaust apparatus or system and more specifically to the structure of an exhaust manifold.

A Published Japanese Patent Application Publication No. H08(1996)-68316 shows an exhaust purifying catalyst unit disposed just below an exhaust manifold to promote the activation of the catalyst after a start of the engine.

SUMMARY OF THE INVENTION

Recently, in order to further hasten the activation of the catalyst, and to improve the exhaust purifying performance, attempts are made to decrease the heat capacity of catalyst carrier and thereby to improve the warming speed with honeycomb catalyst carriers of thinner walls. However, the decrease of the carrier wall thickness could cause erosion by granulated foreign objects contained in exhaust gases (such as welding spatters), and cracks due to localized temperature difference caused by nonuniformity in exhaust gas streams.

When a confluence angle between two exhaust manifold branches is large and an expanding flare section is connected directly to the confluence as in the exhaust system of the above-mentioned document, the exhaust stream is introduced into the catalyst in an oblique direction forming a larger angle (greater than 30°) with a center axis of the catalyst unit. Therefore, particles contained in the exhaust stream could cause erosion by colliding against cell walls of catalyst carriers at the entrance, and particles lingering at the entrance could scrape the cell walls and cause erosion by moving minutely with incoming exhaust stream.

When exhaust gas streams are introduced into the catalyst through an expanding flare section immediately after the confluence, the flow velocity distribution could be uneven in the entrance of the catalyst and the temperature distribution could be too irregular in carriers to cause cracks for example in the case of transition from a medium and high load operation near the maximum speed, to a decelerating operation with fuel cutoff.

It is an object of the present invention to provide an engine exhaust apparatus adequate for preventing erosion and heat deterioration and improving emission control performance and durability.

According to one aspect of the present invention, an engine exhaust apparatus comprising: an exhaust manifold which comprises: a plurality of exhaust branches extending toward a confluence portion, from respective upstream ends to be connected with cylinders of an engine; and a straight pipe section extending from the confluence portion at which exhaust streams in the exhaust branches merge, toward a downstream end adapted to be connected to an exhaust purifying catalyst.

DETAILED DESCRIPTION OF THE INVENTION

Figure 1:
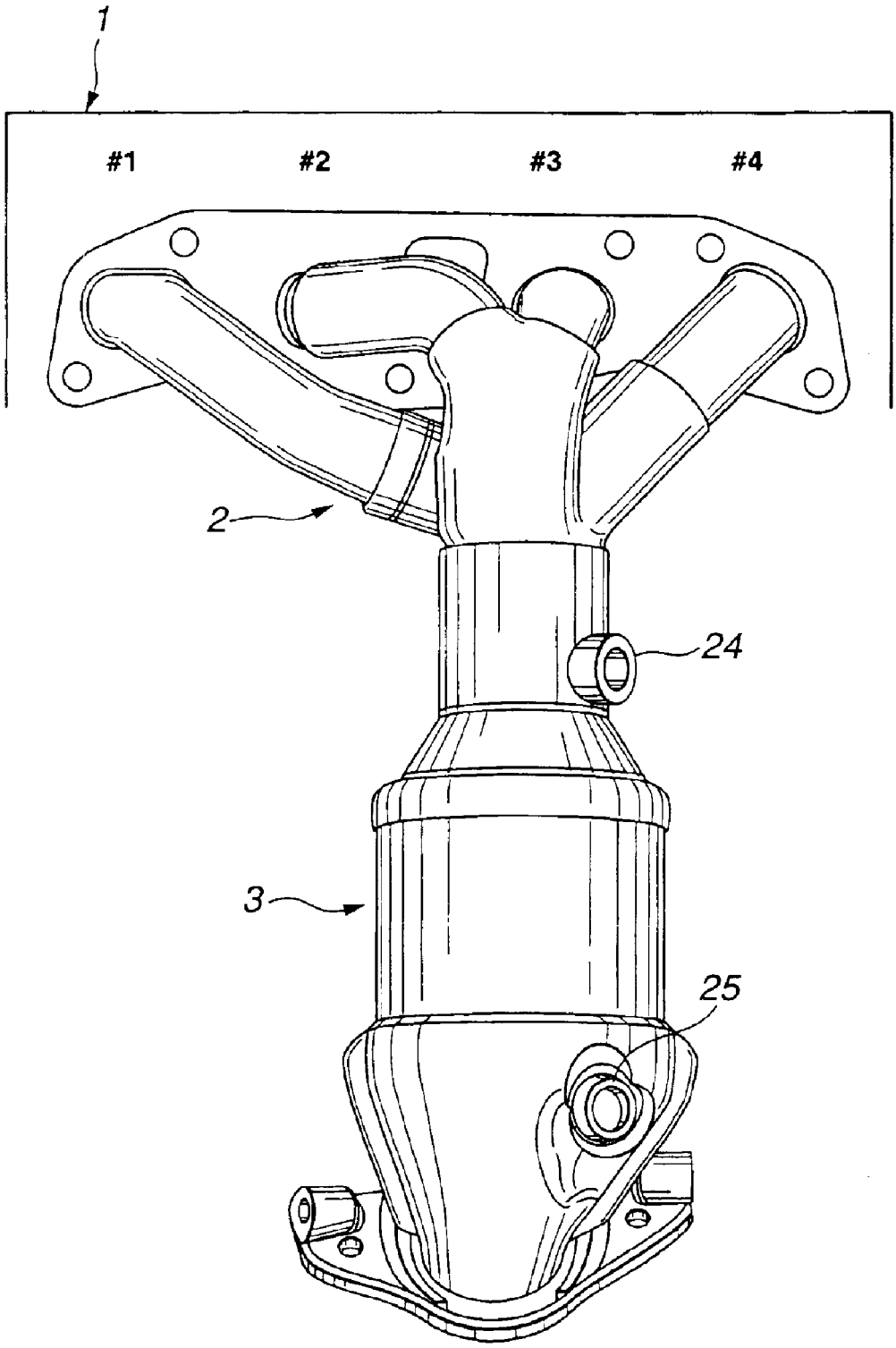
FIG. 1 is a schematic perspective view showing an engine exhaust apparatus according to one embodiment of the present invention.

FIG. 1 shows an engine exhaust system according to one embodiment of the present invention. An engine 1 of this example is a four cylinder engine. The firing order is: #1→#3→#4→#2.

An exhaust manifold 2 is fixed to one side of a cylinder head of engine 1, and connected with exhaust ports of the cylinders of engine 1. An exhaust purifying catalyst (or manifold catalyst unit) 3 is connected with an outlet (or downstream end) of exhaust manifold 2.

Figure 2:
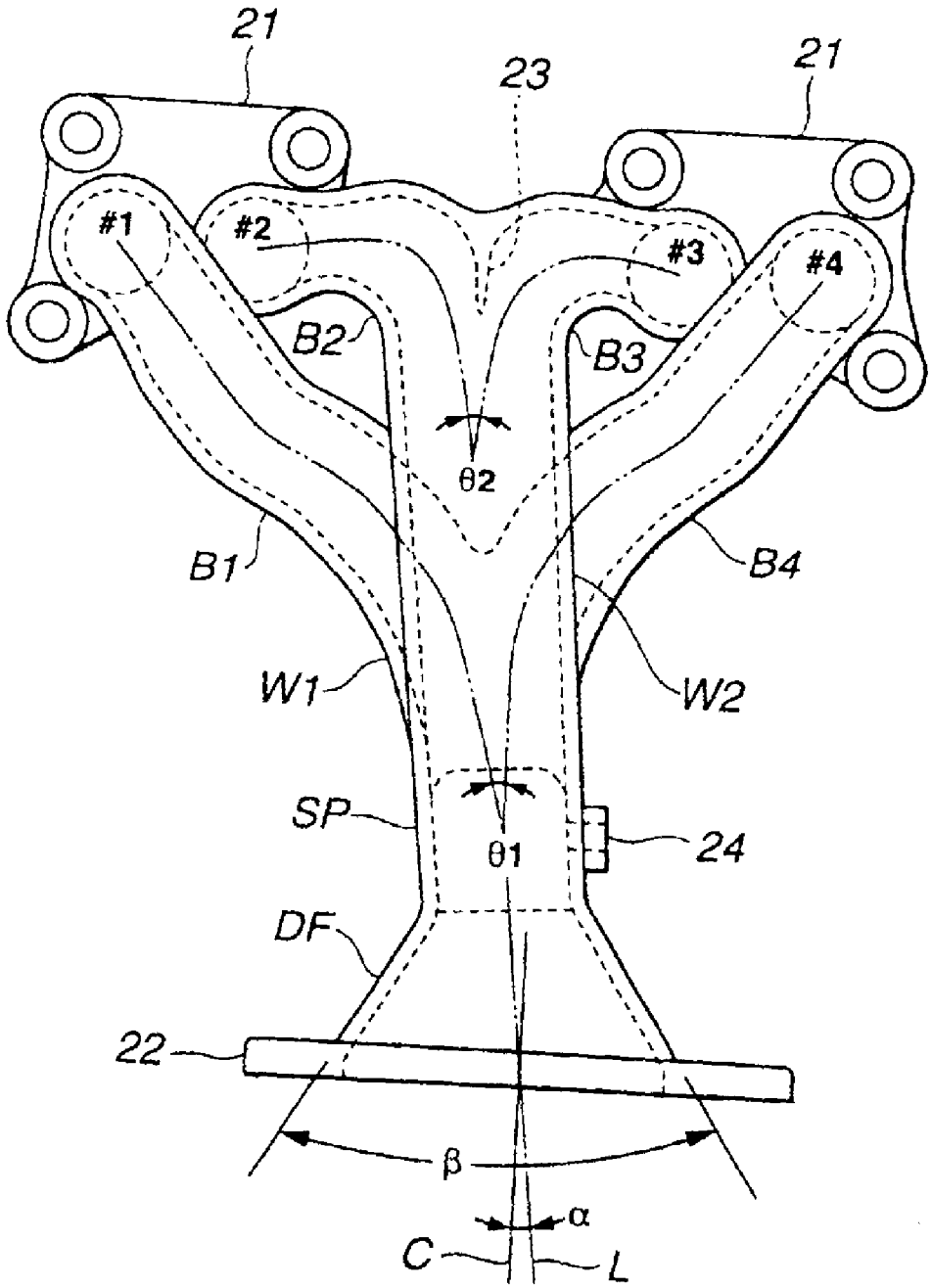
FIG. 2 is a front view of an exhaust manifold shown in FIG. 1.
Figure 3:
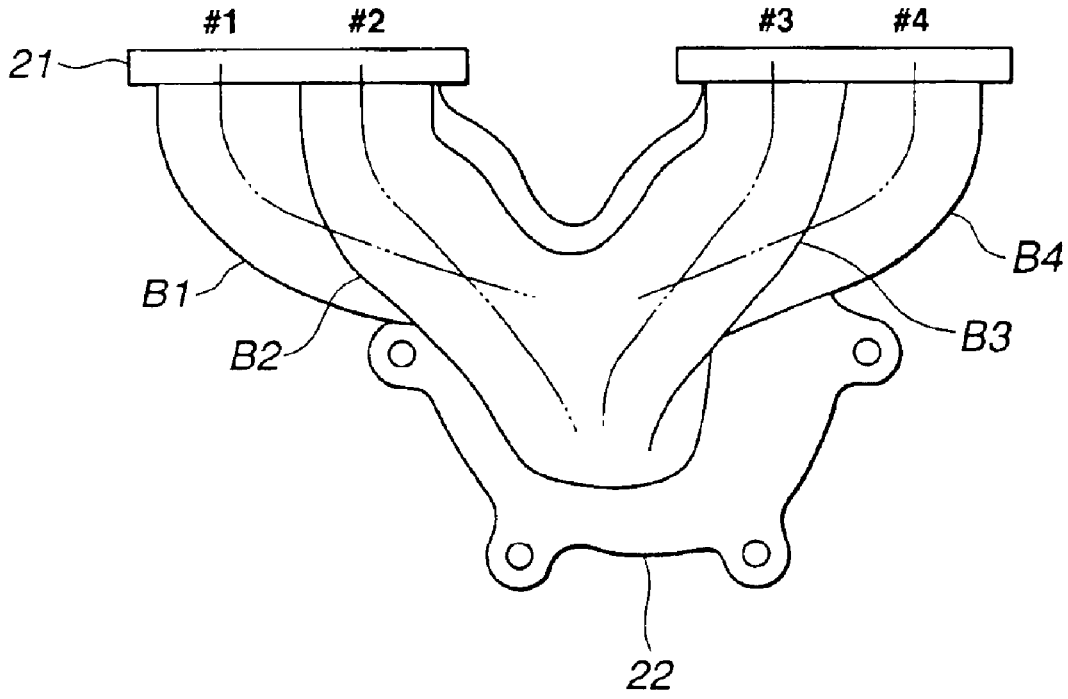
FIG. 3 is a plan view of the exhaust manifold.
Figure 4:
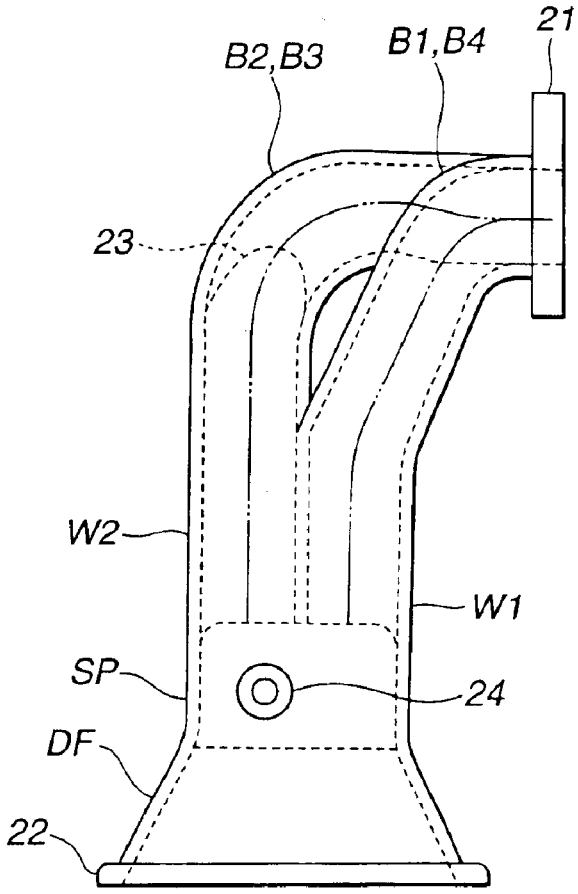
FIG. 4 is a side view of the exhaust manifold.
Figure 5:
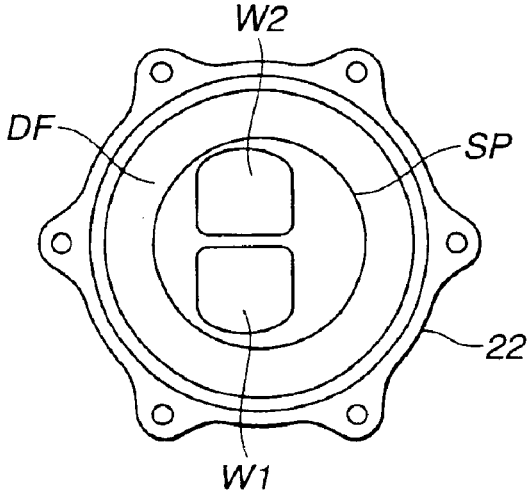
FIG. 5 is a bottom view of the exhaust manifold.

FIGS. 2~5 show exhaust manifold 2 more in detail. FIG. 2 is a front view of exhaust manifold 2; FIG. 3 a plan view; FIG. 4 a side view; and FIG. 5 a bottom view. Exhaust manifold 2 of the illustrated example includes four exhaust branches (exhaust manifold branches) B1~B4, first and second combined (or confluence) branches W1 and W2, a straight pipe section (collecting section) SP, and a flare section (or diffuser section) DF. Four exhaust branches B1~B4 are connected with the outlets of the exhaust ports through flanges 21. First combined branch W1 is connected with first and fourth exhaust branches B1 and B4, and arranged to form a confluence of exhaust streams of branches B1 and B4 from #1 cylinder and #4 cylinder which are not consecutive in the firing order, and which are outer cylinders in the cylinder row. Second combined branch W2 is connected with second and third exhaust branches B2 and B3, and arranged to form a confluence of exhaust streams of branches B2 and B3 from #2 cylinder and #3 cylinder which are not consecutive in the firing order, and which are inner cylinders in the cylinder row. In the cylinder row, #2 cylinder and #3 cylinder are located between #1 cylinder and #4 cylinders. Straight pipe section SP is connected with first and second combined branches W1 and W2 to form a confluence of the two combined branches. From the junction at which the exhaust streams of two combined branches W1 and W2 merge, straight pipe section SP extends straight to the inlet (or upstream end) of flare section DF. Flare (diffuser) section DF is conical in this example, and expands outwards so that the diameter of flare section DF increases gradually from the inlet to the outlet (or downstream end). Manifold catalyst 3 is fixed to the outlet of flare section DF through a flange 22.

First and fourth exhaust branches B1 and B4 extend, respectively, from the exhaust ports of #1 cylinder and #4 cylinders, obliquely and downwardly toward the confluence point located below the middle between the outlets of the exhaust ports of #1 cylinder and #4 cylinders, and meets together at an confluence angle (or convergence angle) θ1 equal to or smaller than 20°. Confluence angle θ1 is defined as an angle formed between a center line of first exhaust branch B1 and a center line of fourth exhaust branch B4 at an intersection.

From the outlets of the exhaust ports of #2 and #3 cylinders located between #1 and #4 cylinders, respectively, second and third exhaust branches B2 and B3 project forward, extends laterally toward each other, and meets together at a shorter distance. A partition wall 23 is formed at the confluence between second and third exhaust branches B2 and B3, and arranged to define a confluence angle (or convergence angle) θ2 between second and third branches B2 and B3, smaller than or equal to 20°.

First combined branch W1 connected with outer branches B1 and B4 extends downwards between second combined branch W2 and engine 1, as shown in FIG. 4. First and second combined braches W1 and W2 extend downwards, side by side, approximately in parallel to each other. The confluence point between second and third branches B2 and B3 is located at a higher position. Accordingly, second combined branch W2 includes a long straight section extending downwards. First combined branch W1 also includes a straight section, but the straight section of first combined branch W1 is shorter than that of second combined branch W2.

A confluence angle (or convergence angle) θ3 between first and second combined branches W1 and W2 is set smaller than or equal to 20°. In the illustrated example, first and second combined branches W1 and W2 extend straight side by side in the downward direction, and open straight into straight pipe section SP, so that the confluence angle between the two combined branches is equal to 0°. In this example, therefore, all the three confluences are so arranged that the tributaries meet together at a sharp confluence angle smaller than or equal to 20°.

An inclination angle a formed by a center line L of straight pipe section SP and a center line C of manifold catalyst 3 is smaller than or equal to 30°, as shown in FIG. 2. Both center lines L and C may be aligned in a line, and hence the inclination angle a may be equal to zero. Therefore, center line L of straight pipe section SP forms an angle in the range of 90°±30°, with a flat joint surface of flange 22 at the outlet of exhaust manifold 2, or a flat joint surface of exhaust catalyst 3 on the inlet side.

Straight pipe section SP is formed with a hole 24 for mounting an air-fuel ratio sensor (or $O_2$ sensor). This mounting hole 24 is opened at an intermediate position in an outside wall of straight pipe section 2. A hole 25 shown in FIG. 1 is for mounting an air-fuel ratio sensor (or $O_2$ sensor) on the downstream side of catalyst 3.

Flare section DF of this example is conical and flaring toward the downstream end 22 of exhaust manifold 2. An expanding angle β as shown in FIG. 2 is set smaller than or equal to 60°.

Manifold catalyst 3 includes a catalyst carrying ceramic carrier of a honeycomb structure having thin walls or honeycomb walls of a wall thickness less than or equal to 3 mil (=3×25.4/1000=0.076 mm). In this example, the wall thickness of the honeycomb partition wall is equal to about 2 mil (=2×25.4/1000=0.051 mm). The number of cells per 1 $inch^2$ is 900.

The thus-constructed exhaust apparatus according to this embodiment is operated as follows: This system combines earlier the exhaust streams from two cylinders which are not adjacent to each other in the firing order, and hence this system is less susceptible to undesired influence of exhaust interference. Therefore, this system can decrease the total length of the exhaust pipes without causing a torque decrease in the low and medium speed region.

For #2 and #3 cylinders, branches B2 and B3 are so arranged that branches B2 and B3 project laterally toward each other and meets at the shortest distance at the confluence point. After the confluence point, the second combined branch W2 is in the form of a straight long pipe. This arrangement can help decrease the total length of exhaust piping, and thereby improve the ability to increase the temperature of manifold catalyst 3 after a start of engine 1.

Figure 6A:
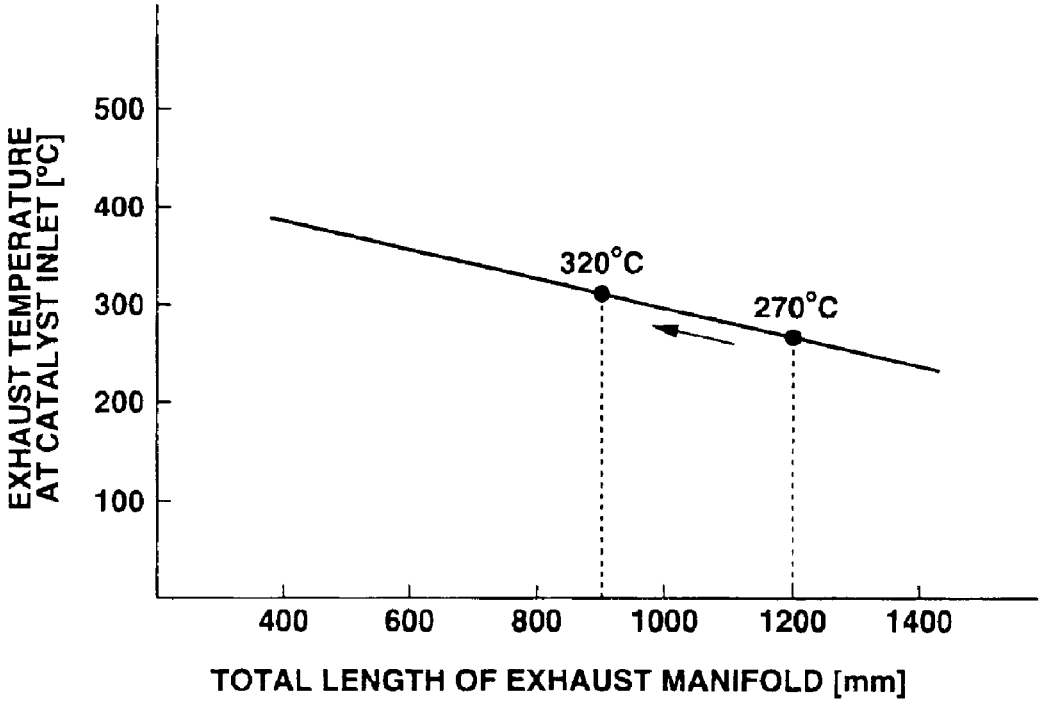
FIG. 6A is a graph showing a relationship between a total length of exhaust manifold piping and an exhaust temperature.
Figure 6B:
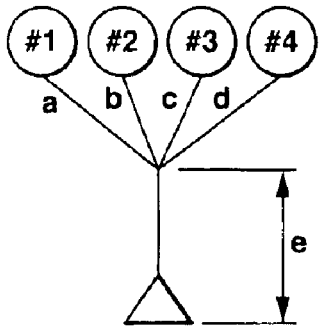
FIGS. 6B and 6C are schematic views illustrating the total exhaust piping lengths in two different exhaust manifold piping systems.
Figure 6C:
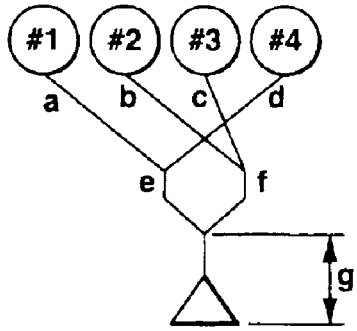
Figure 7:
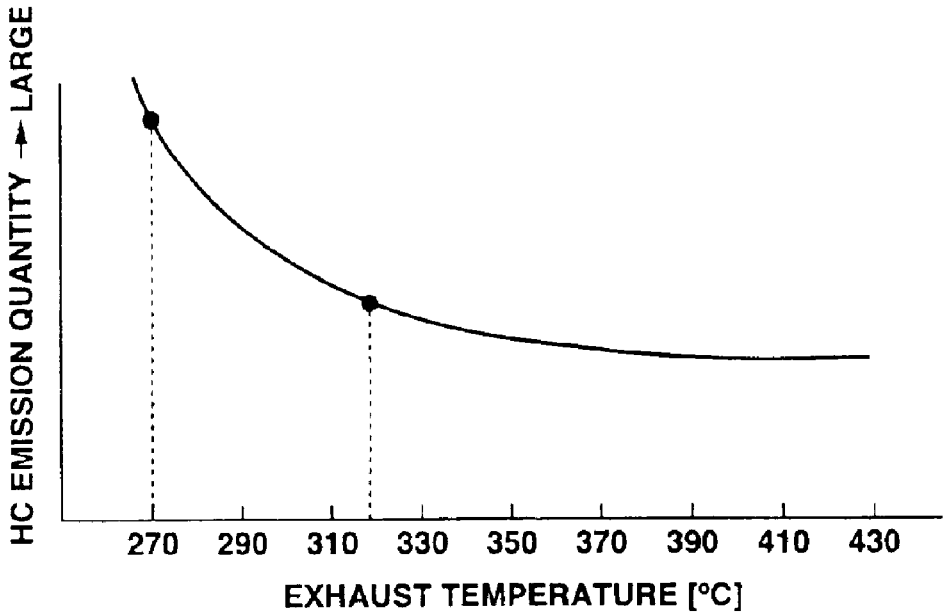
FIG. 7 is a graphs showing a relationship between an exhaust gas temperature and an HC emission quantity.

FIG. 6A shows a relationship between the total exhaust manifold pipe length and the exhaust temperature (specifically, the exhaust temperature just before manifold catalyst 3 at 15 seconds after an engine start). It is possible to increase the exhaust temperature just before manifold catalyst 3 from 270° C. to about 320° C. if the total exhaust pipe length can be decreased from 1200 mm to 900 mm. The total exhaust pipe length is a total of lengths of exhaust branches and lengths of combined branches. In the case of FIG. 6B, the total exhaust pipe length is equal to a+b+c+d+e. In the case of FIG. 6C, the total exhaust pipe length is equal to a+b+c+d+e f+g. FIG. 7 shows a relationship between the exhaust temperature at a position just before manifold catalyst 3 after 15 seconds after an engine start, and an HC emission (or discharge) quantity at the outlet of the catalyst during that time duration. By increasing the exhaust temperature from 270° to 320°, this exhaust system according to the embodiment can promote the activation of manifold catalyst, and thereby reduce the HC emission.

Figure 8:
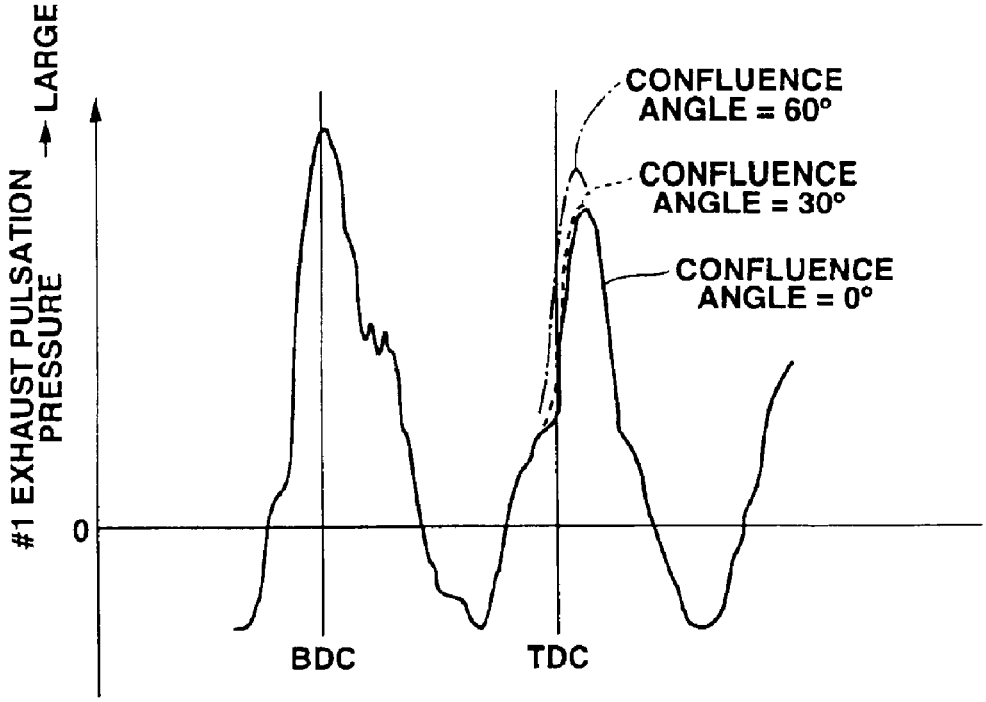
FIG. 8 is a graph showing influence on an exhaust gas pulsation pressure by a confluence angle of exhaust manifold branches.

The arrangement of sharp confluence angle smaller than or equal to 20° between two branches is effective for reducing the exhaust interference by preventing exhaust pulsation from propagating around a sharp turn. If a confluence angle is larger, a blow down wave can readily propagates from #1 cylinder around the blunt confluence. Therefore, the blow down wave can cause exhaust interference on another cylinder by facilitating the propagation of blow down wave, and cause exhaust interference on its own #1 cylinder by reflection from a closed exhaust valve of another cylinder. FIG. 8 shows the results of measurement of exhaust pulsation pressure at the outlet of the exhaust port of #1 cylinder in arrangements of confluence angles of 60°, 30° and 0°. As shown in FIG. 8, by decreasing the confluence angle, it is possible to decrease the exhaust pulsation pressure in the vicinity of a valve overlap from the intake valve opening timing to the exhaust valve closing timing, and thereby to reduce the exhaust interference. When the confluence angle is smaller than or equal to 30°, the exhaust interference is as low as the level of the arrangement having a confluence angle of 0°.

Figure 9:
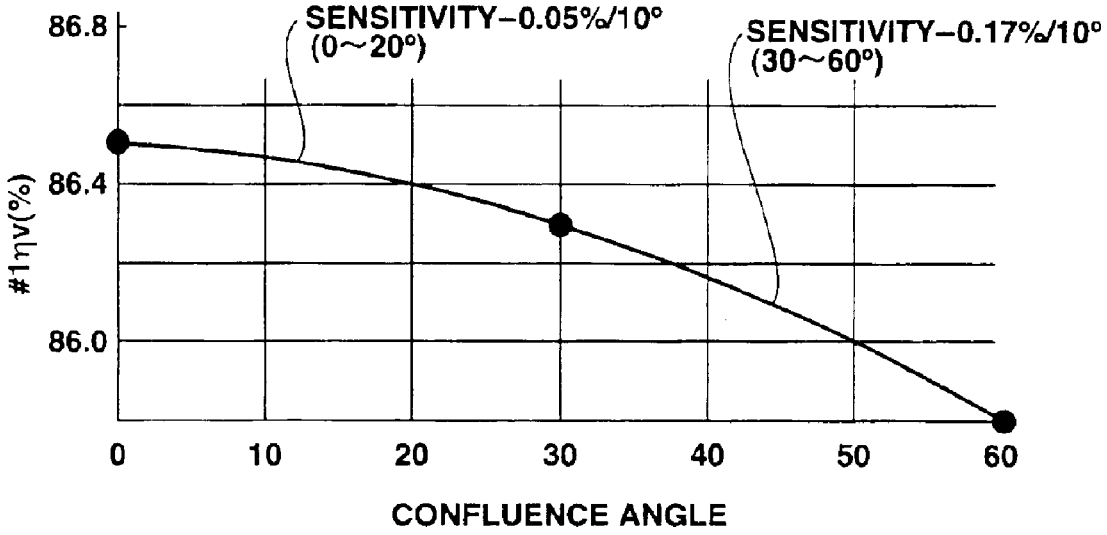
FIG. 9 is a graph showing a relationship between the confluence angle and an intake volumetric efficiency.

FIG. 9 shows a relationship between the confluence angle and intake volumetric efficiency (ηv). As shown in FIG. 9, in the range of the confluence angle from 30° to 60°, the sensitivity is −0.17%/10° (the volumetric efficiency decreases by 0.17% each time the confluence angle is increased by 10°). In the confluence angle range of 0°~20°, the sensitivity is −0.05%/10° (the volumetric efficiency decreases by 0.05% each time the confluence angle is increased by 10°). Namely, an increase in the confluence angle in the range of 0°~20°exerts little influence on a decrease in the intake volumetric efficiency. In the confluence angle range beyond 20°, the volumetric efficiency decreases sharply with an increase in the confluence angle especially when the confluence angle exceeds 30°. Therefore, the system according to the illustrated embodiment can decrease the exhaust interference securely by setting the confluence angle lower than or equal to 20°.

Figure 10:
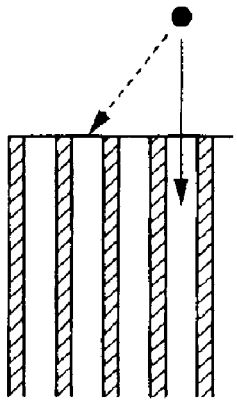
FIG. 10 is a schematic view showing behavior of a particle flowing into a catalyst.

In the illustrated embodiment of the present invention, straight pipe section SP is interposed between the confluence of the first and second combined branches W1 and W2 and the exhaust purifying catalyst 3. This straight pipe section SP functions to determine the direction of the combined exhaust stream after the confluence and to introduce the combined exhaust stream in a direction approximately along the center line C of exhaust purifying catalyst 3 (or the longitudinal direction of exhaust catalyst 3), into manifold catalyst 3. Foreign objects even if included in the exhaust could pass through cell chambers without colliding against cell walls of the catalyst carrying carrier. Therefore, this arrangement can restrain erosion. As shown in FIG. 10, a foreign object could collide against a cell wall when the object flows obliquely into manifold catalyst 3, as shown by a broken line. In the case of the flow direction shown by a solid line in FIG. 10, the foreign object is introduced into exhaust purifying catalyst 3 along the cell walls, so that the probability of the particle passing through a cell chamber becomes higher. Therefore, the arrangement of straight pipe section SP can prevent erosion due to collision of foreign objects against carrier cell walls, and damage of cell wall ends due to violent action of foreign objects remaining at the inlet of the catalyst carrier.

Figure 11:
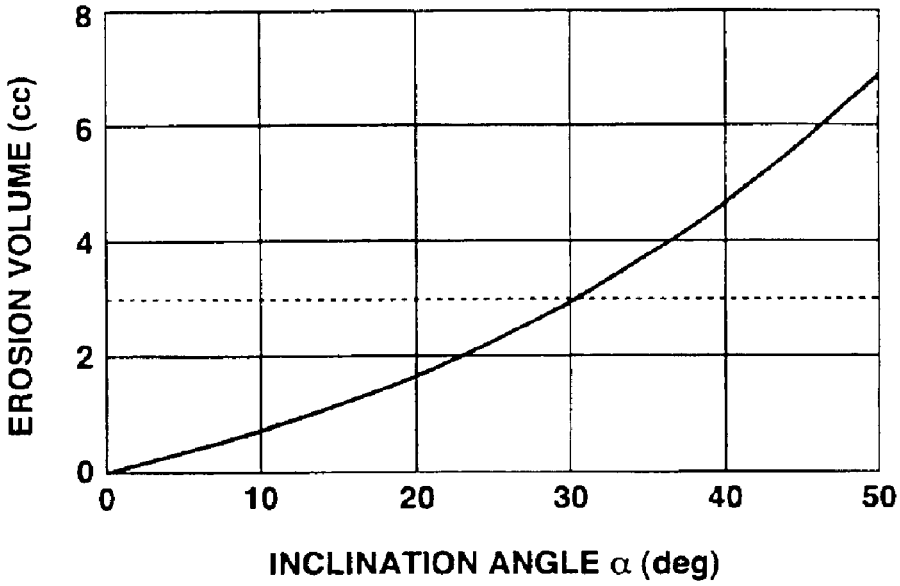
FIG. 11 is a graph showing a relationship between an inclination angle and an erosion volume.

FIG. 11 shows the results of an endurance test corresponding to a travel of 150,000 kilometer. In this test, erosion volume (cc) was measured for various values of the inclination angle α between the center line of straight pipe section SP and the center line of exhaust purifying catalyst 3. The inclination angle should be set smaller than or equal to 30° when an allowable erosion volume is 3 cc.

Nonuniformity in the exhaust gas velocity distribution in the end surface of the manifold catalyst could cause one-sided stream, and excessive local temperature difference in the catalyst carrier under some engine operating conditions, resulting in cracks. However, the straight pipe section SP can serve as a runway for mixing the exhaust gas streams, and uniformize the flow velocity distribution in the catalyst.

With flare section DF having an expanding angle equal to or smaller than 60°, the exhaust passage is expanded smoothly to the inlet of manifold catalyst 3. Flare section DF contributes to the uniformization of the flow velocity distribution.

Exhaust branches B2 and B3 for #2 and #3 cylinders are arranged to meet at a shorter distance, and these braches B2 and B3 are shorter than exhaust branches B1 and B4. Therefore, the second combined branch W2 can serves as a long runway and contribute to the uniformization of exhaust gas flow velocity distribution of the exhaust gas flow flowing into the catalyst.

Figure 12A:
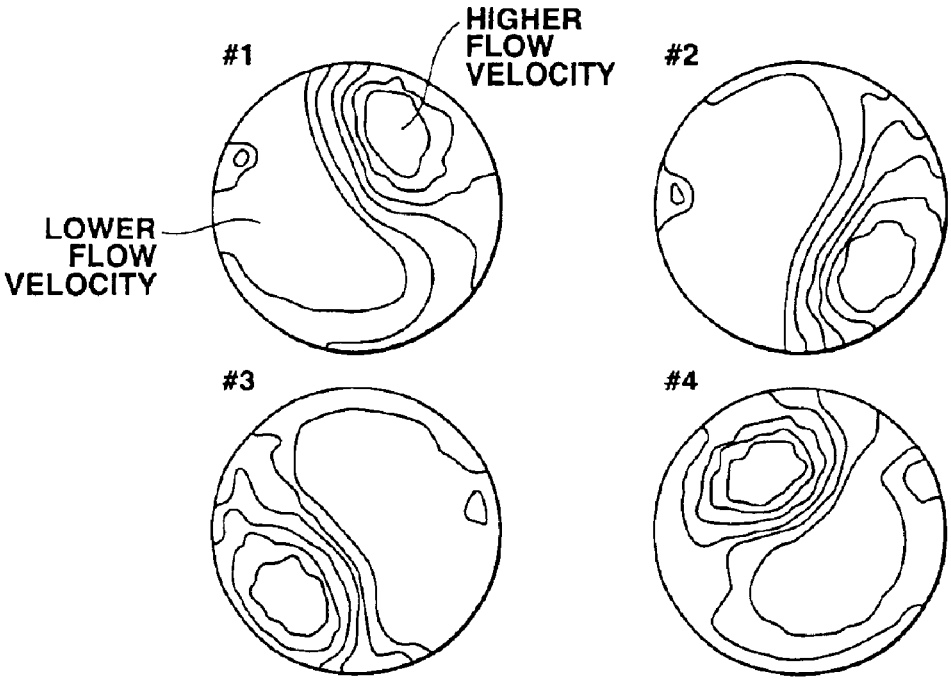
FIGS. 12A and 12B are views showing flow velocity distribution at the inlet end of the catalyst in the embodiment in comparison with a comparative example.
Figure 12B:
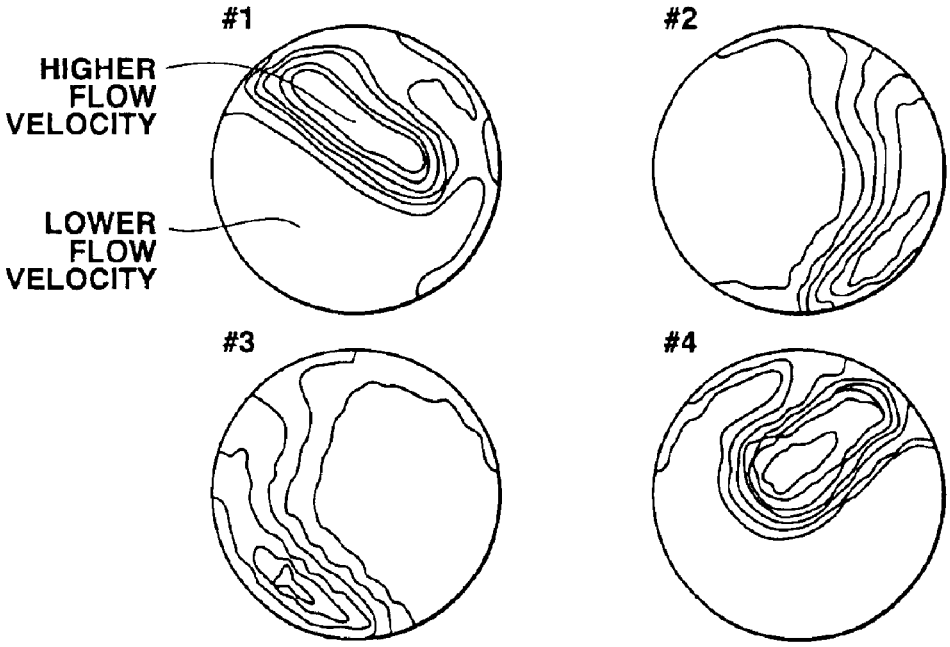

FIG. 12A shows flow velocity distribution in the inlet of the manifold catalyst measured at a timing of exhaust gas stream flowing into the catalyst from each of the four cylinders #1~#4 in the engine system according to the illustrate embodiment. FIG. 12B shows the results of a comparative example in which the confluence angle between branches is greater, there is no straight pipe section and the expanding angle of a diffuser section is greater. The nonuniformity is lower in the case of FIG. 12A as compared to the comparative example of FIG. 12B. The degree of nonuniformity or irregularity in the flow rate distribution can be expressed numerically as:

$$\gamma=1-\Sigma(|Vi-Vave|/Vave)$$

In this equation, Vi is a flow velocity in each of various portions in the inlet end, and Vave is an average of the flow velocities in the various portions. The irregularity is greater when this quantity γ is smaller. The uniformity is greater as γ increases.

Figure 13:
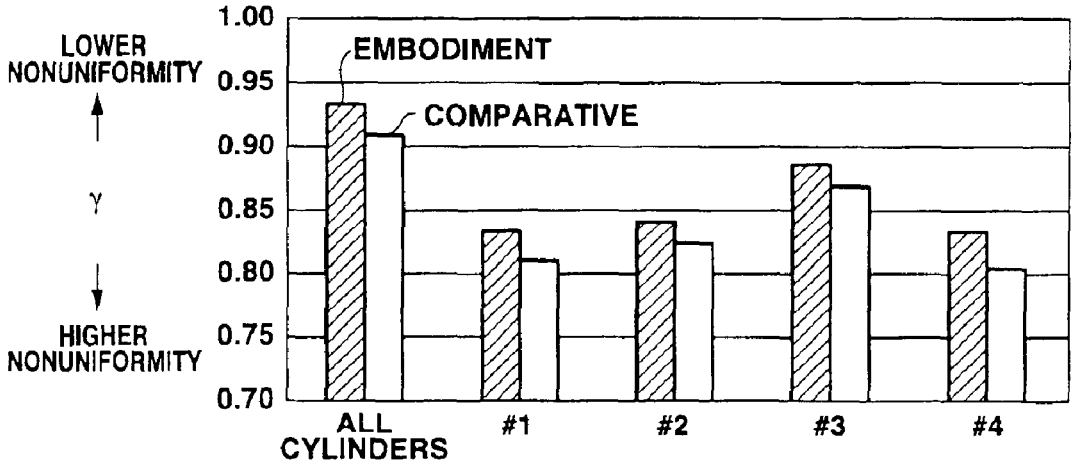
FIG. 13 is a graph showing the degree of nonuniformity in the flow velocity distribution in the embodiment in comparison with the comparative example.

FIG. 13 shows the degree γ of nonuniformity calculated for the totality of all the cylinders and each cylinder in the illustrated example according to the embodiment and the comparative example. As shown in FIG. 13, the irregularity is lower and the uniformity is higher in the case of the illustrated example as compared to the comparative example.

Figure 14:
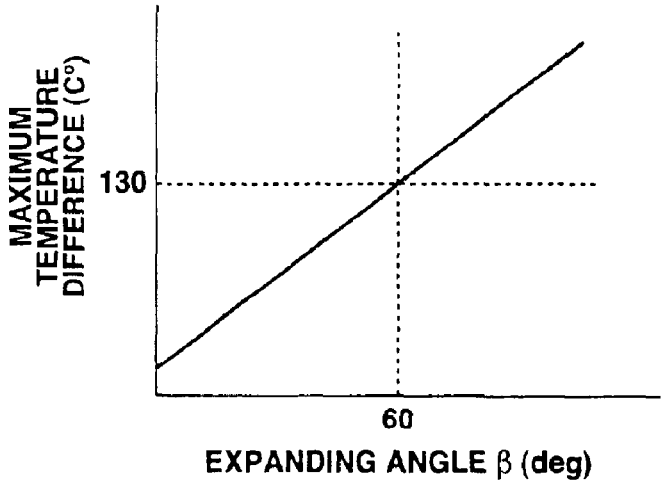
FIG. 14 is a graph showing a relationship between an expanding angle and an maximum temperature difference.

FIG. 14 shows the result of measurement of a greatest temperature difference in the inlet end of the manifold catalyst when the expanding angle β of the flare section DF was varied. As evident from FIG. 14, the expanding angle β should be set smaller than or equal to 60° if an allowable greatest temperature difference is 130°.

Figure 15:
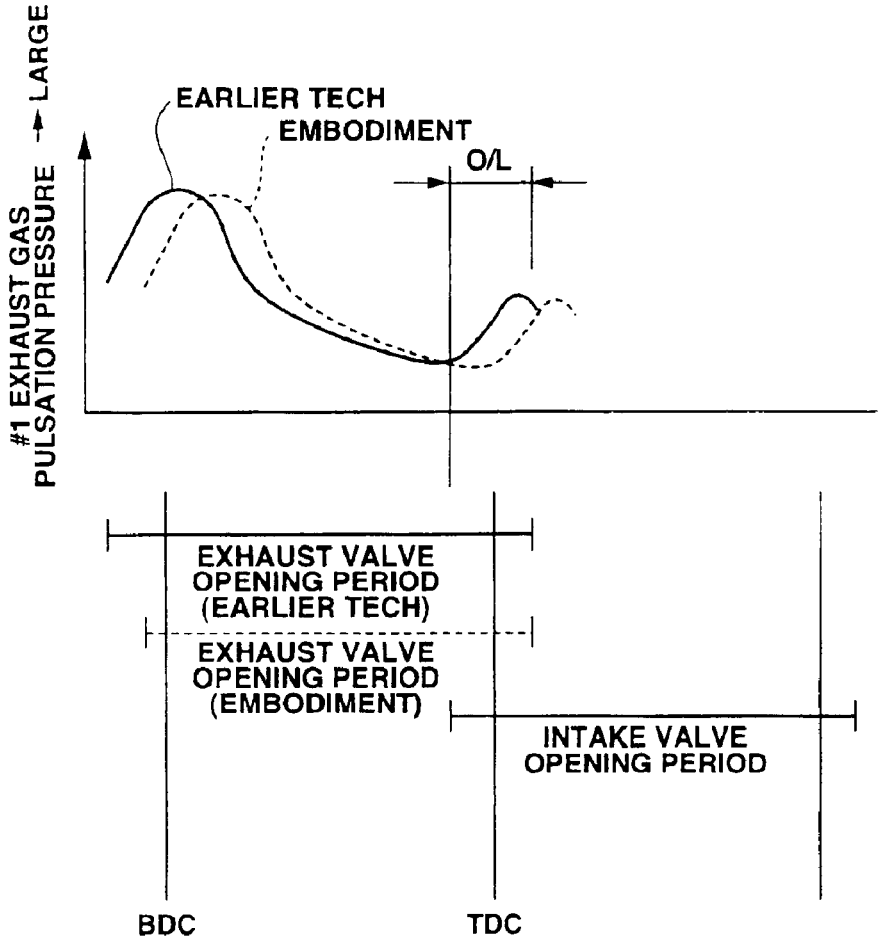
FIG. 15 is a graph showing an effect due to retardation of an exhaust valve opening timing.
Figure 16:
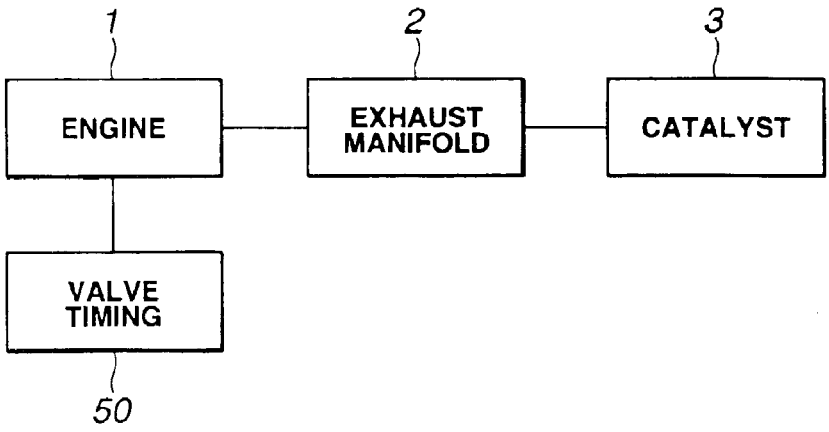
FIG. 16 is a block diagram schematically showing a valve timing adjusting system which can be employed in the embodiment.

FIG. 15 shows reduction of exhaust interference by retardation of the exhaust valve opening timing of the engine. In general, the exhaust valve opens about 45° before bottom dead center (BDC). However, in this example of the embodiment, the exhaust valve opening timing is set after 30° before bottom dead center, and set in the range from 30 before bottom dead center, to the bottom dead center. This example according to the embodiment can retard the timing of blow down as shown by broken lines in FIG. 15, as compared to an ordinary example shown by solid lines of earlier technology. By so doing, the engine system of this example can improve the exhaust interference during a valve overlap (O/L) by preventing a reflected wave from reaching a cylinder during its valve overlap, and thereby improve the torque in the low and medium speed region. Adjustment of the exhaust valve opening timing can be achieved by a valve timing adjusting mechanism 50 shown in FIG. 16. For example, the adjustment of the exhaust valve opening timing can be achieved by decreasing an operating angle of an exhaust valve driving cam, varying an operating angle of an exhaust valve with a variable valve timing mechanism, varying an exhaust valve operating angle and a valve lift, and shifting a center position of an exhaust valve operation. Valve timing adjusting mechanism 50 may include a variable valve timing mechanism. When the exhaust valve operating angle is decreased, the torque could be decreased in return in the high speed region. However, this is surmountable with improvement in flow resistance in the exhaust manifold by setting the expanding angle β of the flare section smaller than or equal to 60°, and/or by setting a ratio of a bending radius to a pipe diameter of an exhaust manifold branch equal to or greater than 1.5. When a variable valve timing system is employed, the retardation of the exhaust valve opening timing may be performed limitedly only in a low and medium speed region (lower than or equal to 4000 rpm, for example).

The position of an air fuel ratio sensor can be determined in the following manner. In the illustrated example, the air fuel ratio sensor is mounted in straight pipe section SP. This arrangement is advantageous for narrowing down various factors to be tuned to determine an optimum sensor position for the sensitivity of the air fuel ratio sensor for each cylinder, and for facilitating the determination of the optimum sensor position. In this example, the position of mounting hole 24 for the air furl ratio sensor is determined by adjusting the sensor in the left and right direction in FIG. 4 to examine the sensitivity for #1 and #4 cylinders and the sensitivity for #2 and #3 cylinders, and finding the optimum position for both groups of cylinders.

In this embodiment, the inclination angle is smaller than or equal to 30° between the center line of straight pipe section SP and the center line of the manifold catalyst. This arrangement can improve the erosion resistance of the manifold catalyst. Moreover, the flare section DF having an expanding angle smaller than or equal to 60° is effective for uniformizing the flow velocity distribution and temperature distribution in the catalyst, and improving the heat resistance.

When combined with a catalyst of thin wall catalyst carriers having wall thickness equal to or smaller than 3 mil, the exhaust system according to this embodiment can reduce the time for activating the catalyst by decreasing the heat capacity while preventing erosion.

The exhaust streams from two cylinders that are not consecutive in the firing order are combined into a combined branch at a sharp confluence angle smaller than or equal to 20°, and the combined branches are combined into a common collecting section. This arrangement can reduce the exhaust interference significantly, prevent a decrease in torque in the low and medium speed ration, reduce the total length of the exhaust piping by minimizing the length of an independent section of the piping, and raise the temperature of the catalyst quickly after a start of the engine.

Moreover, the combined branches are combined at a confluence angle smaller than or equal to 20°. Therefore, this system can further prevent the exhaust interference, and prevent a decrease in torque in the low and medium speed region. The exhaust branches for inner cylinders such as #2 and #3 cylinders are combined earlier on the upstream side. This arrangement helps reduce the exhaust interference, decrease the total length of exhaust piping, and increase the temperature of the manifold catalyst. The exhaust branches for inner cylinders project and extend laterally to meet at the nearest position. This arrangement helps decrease the total length of exhaust piping and reduce the time for activating the catalyst.

The combined branch (such as W2) for inner cylinders includes a long straight section. This arrangement helps decrease the total length of exhaust piping and reduce the time for activating the catalyst. In the illustrated example, the exhaust valve is set to open at a timing later than 30° before BTD. This retardation of the exhaust valve opening timing retards the timing of blow down, reduce the exhaust interference during valve overlap and improve the torque in the low and medium speed region.

In the illustrated embodiment, the straight pipe section SP extends straight, and the cross sectional area of the straight pipe section SP is uniform from the upstream end to the downstream end of straight pipe section SP. Exhaust branches B1~B4 serve as means for conveying exhaust, from the exhaust ports of the engine, toward a confluence portion. Straight pipe section SP can serve as means for collecting exhaust streams from the exhaust ports at the confluence portion, and directing a combined exhaust stream continuously in a longitudinal direction of the exhaust purifying catalyst.

The present invention is applicable to engines of various types. For example, the present invention is applicable to an eight cylinder engine such as V-type eight cylinder engine.

This application is based on a prior Japanese Patent Application No. 2002-221168 filed on Jul. 30, 2002. The entire contents of these Japanese Patent Application No. 2002-221168 are hereby incorporated by reference.

Although the invention has been described above by reference to certain embodiments of the invention, the invention is not limited to the embodiments described above. Modifications and variations of the embodiments described above will occur to those skilled in the art in light of the above teachings. The scope of the invention is defined with reference to the following claims.

What is claimed is:

1. An engine exhaust apparatus comprising:

an exhaust manifold which comprises:

a plurality of exhaust branches extending toward a confluence portion, from respective upstream ends to be connected with cylinders of an engine; and a straight pipe section extending from the confluence portion at which exhaust streams in the exhaust branches merge, toward a downstream end adapted to be connected to an exhaust purifying catalyst;

a first combined branch into which two of the exhaust branches merge together; and a second combined branch into which other two of the exhaust branches merge together, where the first and second combined branches merge together at the confluence portion into the straight pipe section;

wherein an upstream end of the second combined branch at which the other two of the exhaust branches meet is located on an upstream side of an upstream end of the first combined branch at which the two of the exhaust branches meet.

2. The engine exhaust apparatus as claimed in claim 1, wherein the exhaust manifold further comprises a flare section expanding from the straight pipe section to the downstream end of the exhaust manifold.

3. The engine exhaust apparatus as claimed in claim 2, wherein an expanding angle of the flare section is smaller than or equal to 60°.

4. The engine exhaust apparatus as claimed in claim 1, wherein the exhaust branches connected to the first combined branch are branches to be connected with two of the cylinders of the engine which are not consecutive in a firing order of the engine, and the exhaust branches connected to the second combined branch are branches to be connected with two of the cylinders of the engine which are not consecutive in the firing order of the engine.

5. The engine exhaust apparatus as claimed in claim 1, wherein, in each of the first and second combined branches, the two exhaust branches meet at a confluence angle smaller than or equal to 20°.

6. The engine exhaust apparatus as claimed in claim 1, wherein the first and second combined branches meet at a confluence angle smaller thin or equal to 20°.

7. The engine exhaust apparatus as claimed in claim 1, wherein the exhaust branches connected to the second combined branch extend laterally toward each other.

8. The engine exhaust apparatus as claimed in claim 1, wherein first and fourth branches are connected to the first combined branch, and second and third branches are connected to the second combined branch, the first, second, third and fourth branches are the exhaust branches for first, second, third and fourth cylinders, respectively, of the engine which are arranged in a row so that the second and third cylinders are located between the first and fourth cylinders in the row.

9. The engine exhaust apparatus as claimed in claim 8, wherein the second combined branch comprises a straight section.

10. The engine exhaust apparatus as claimed in claim 9, wherein the first combined branch comprises a straight section shorter than the straight section of the second combined branch.

11. The engine exhaust apparatus as claimed in claim 10, wherein the straight sections of the first and second combined branches extend side by side to the straight pipe section; and the first combined branch is located between the second combined branch and the upstream ends of the exhaust manifold.

12. The engine exhaust apparatus as claimed in claim 1, wherein the downstream end of the exhaust manifold is adapted to be connected with the exhaust purifying catalyst in such a manner that an angle between a center line of the straight pipe section and a center line of the exhaust purifying catalyst is smaller than or equal to 30°.

13. The engine exhaust apparatus as claimed in claim 1, wherein the engine exhaust apparatus further comprises the exhaust purifying catalyst including a thin-wall catalyst carrier of ceramic having a wall thickness smaller than or equal to 3 mil.

14. The engine exhaust apparatus as claimed in claim 1, wherein an exhaust valve opening timing is set in a range from 30° before a bottom dead center to the bottom dead center of the engine.

15. An engine exhaust apparatus comprising:

an exhaust manifold which comprises:

first, second, third and fourth exhaust branches adapted to be connected, respectively, with first, second, third and fourth cylinders of an engine which are arranged in a row so that the second and third cylinders are located between the first and fourth cylinders in the row of the cylinder;

a straight pipe section extending downward from an upstream end portion toward a downstream end of the exhaust manifold adapted to be connected to an exhaust purifying catalyst;

a first combined branch including an upstream end portion into which the first and fourth exhaust branches merge together, and a straight section extending downwards from the upstream end portion of the first combined branch to the upstream end portion of the straight pipe section and a second combined branch including an upstream end portion into which the second and third exhaust branches merge together, and a straight section extending downwards from the upstream end portion of the second combined branch to the upstream end portion of the straight pipe section, the straight section of the second combined branch being longer than the straight section of the first combined branch.

16. The engine exhaust apparatus as claimed in claim 15, wherein the straight sections of the first and second combined branches are separated from each other by a wall, the straight sections of the first and second combined branches extend straight along an imaginary straight line into the upstream end portion of the straight pipe section, and the straight pipe section extends straight along the imaginary straight line.

17. The engine exhaust apparatus as claimed in claim 15, the engine exhaust apparatus further comprises the exhaust purifying catalyst including a catalyst carrying carrier having thin walls extending in a longitudinal direction of the exhaust purifying catalyst, and the straight pipe section extends in such a direction as to cause an exhaust gas stream to flow in the longitudinal direction of the exhaust purifying catalyst, from the exhaust manifold into the exhaust purifying catalyst.

* * * * *